United States Patent [19]

Ours

[11] 4,048,471

[45] Sept. 13, 1977

[54] ELECTRICALLY HEATED SPREADER ASSEMBLY HAVING A DETACHABLE BLADE

[76] Inventor: Frank M. Ours, P.O. Box 370, Parsons, W. Va. 26287

[21] Appl. No.: 585,749

[22] Filed: June 11, 1975

[51] Int. Cl.[2] ..... H05B 1/00; B05C 17/10

[52] U.S. Cl. ..... 219/228; 15/235.4; 16/114 R; 30/140; 38/92; 118/202; 219/256; 219/533

[58] Field of Search ..... 219/221-242, 219/533, 245, 256, 249; 30/140, 169; 38/91, 92; 16/114 R; 15/236, 235.4; 401/1, 2; 118/202, 101

[56] References Cited

U.S. PATENT DOCUMENTS

| | | | |
|---|---|---|---|
| 593,770 | 11/1897 | Hilton | 15/235.4 |
| 962,768 | 6/1910 | Levy | 38/92 X |
| 1,034,129 | 7/1912 | Madsen | 219/256 |
| 1,905,364 | 4/1933 | Brindley | 219/227 |
| 2,217,369 | 10/1940 | Jacobsen et al. | 16/114 R |
| 2,241,067 | 5/1941 | Holm-Hansen | 38/92 X |
| 2,292,700 | 8/1942 | Kennedy | 219/227 |
| 2,623,977 | 12/1952 | Weiskopf | 30/140 |
| 2,785,267 | 3/1957 | Wickersham et al. | 219/237 X |
| 3,325,627 | 6/1967 | Adler et al. | 219/533 X |

FOREIGN PATENT DOCUMENTS

| | | | |
|---|---|---|---|
| 569,999 | 1/1924 | France | 219/256 |
| 1,161,118 | 10/1961 | Germany | 219/229 |
| 34,332 | 1/1912 | Sweden | 219/245 |

*Primary Examiner*—A. Bartis

*Attorney, Agent, or Firm*—Strauch, Nolan, Neale, Nies & Kurz

[57] ABSTRACT

An electrically heated spreader assembly for spreading, smoothing and curing plastic filler material, as in automobile body dents, includes an elongated handle provided with an slide track along a longitudinal edge. A stiff elongated spreader blade made of a synthetic plastic, such as Teflon or nylon, has an electrical heating element embedded therein and is provided along a longitudinal edge with flanged slide means adapted to be slidably received in and interfit with the slide track to secure the handle and blade together. The blade and handle are provided with separable electrical contacts which cooperate to establish an electrical connection between the heating element in the blade and an electrical supply cord on the handle when the blade has been slidably mounted in operative position on the handle.

9 Claims, 3 Drawing Figures

ELECTRICALLY HEATED SPREADER ASSEMBLY HAVING A DETACHABLE BLADE

This invention relates to spreader assemblies, and particularly to a special assembly of this type wherein a spreader blade unit containing an imbedded heating element is detachably connected to an operating handle unit.

The invention finds particularly utility in the repair of dents and the like in metal automobile body and fender surfaces.

Auto body plastic filler having a polyester resin base is in general widespread use both in the auto body repair business and in auto factories. This plastic filler is mainly used for filling and smoothing dents and misshaped body panels. The plastic is shipped in a soft state and cures when a hardening agent is mixed with it. As the chemical reaction which takes place during curing is exothermic, the speed at which the plastic cures and sets is directly proportional to its temperature. When repair men mix and apply the plastic at normal room temperatures, they must wait a number of minutes until hardening reaches a state where the repaired surface can be shaped and further smoothed with filing and sanding tools. By the application of sufficient heat, this curing time may be greatly reduced. This is often done in body shops by warming the applied plastic in the repair areas with a bank of infrared heat lamps. Care must be used to avoid blistering the plastic. This quick curing can be done less expensively and without risk of such blistering with the use of the hot spreader of the invention.

It is therefore the major object of the invention to provide a novel hot spreader assembly for conditioning plastic filler, as in automotive body repairs.

A further object of the invention is to provide a novel hot spreader blade assembly wherein the blade unit containing an imbedded heater element may be readily assembled on or detached from a relatively sturdy handle unit.

Another object of the invention is to provide a novel hot spreader blade assembly wherein the blade and handle are slidably connected and the blade contains an electrical heater element and has a plug-in electrical contact fit with the handle.

PREFERRED EMBODIMENTS

Figure 1:
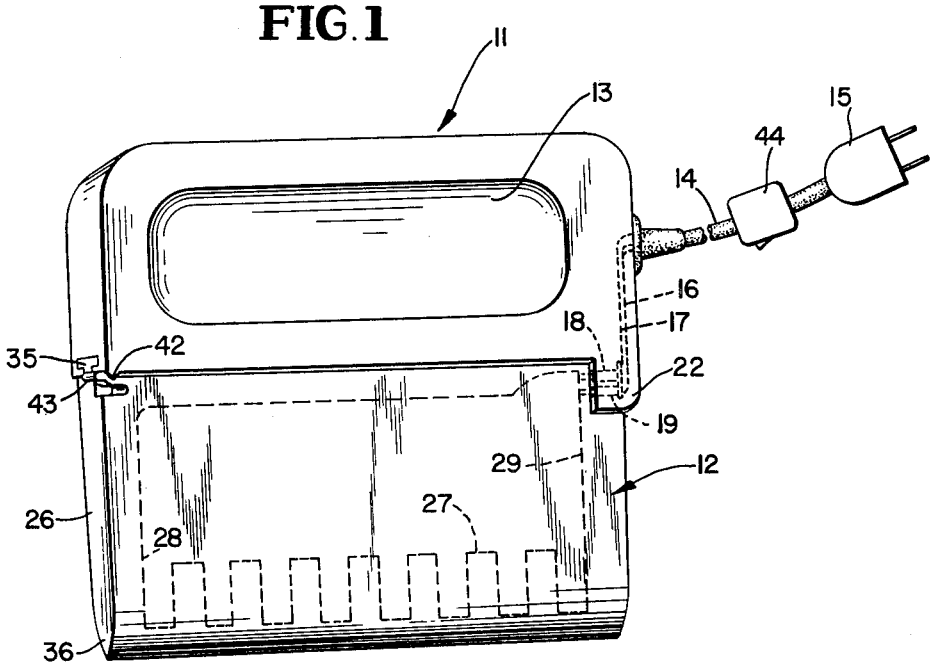
FIG. 1 is a side elevation showing the invention in a preferred embodiment.

The manual electrically heated spreading tool assembly of the invention consists essentially of a handle unit 11 and a detachable spreader blade unit 12.

Handle 11 preferably comprises a strong metal core 9 or frame covered with a suitable synthetic electrically insulating plastic 10 that has low heat conductivity. The frame gives the handle rigidity during working, and the plastic covering provides heat insulation enabling the worker to tightly grip the handle comfortably. Optionally the handle may be an integral solid part of low heat conductive electrically insulating plastic. The metal may be aluminum, and the plastic may be Bakelite or a synthetic rubber, or any suitable heat insulation material. Cork may be suitable as a handle covering for some assemblies.

Opposite sides of the handle are depressed as at 13, to form a comfortable steady grip for the hand of the operator. Alternatively there may be a through recess at 13.

An electrical supply cord 14 having a plug 15 at one end for insertion in the usual electrical outlet receptacle provides wires 16, 17 that extend through the insulating plastic of the handle to terminate in hollow socket contacts 18 and 19 fixed in the plastic at a flat face 21 on a depending end portion 22 of the handle.

Along its lower edge, handle 11 has formed in the plastic a straight longitudinal slide guide track 23 that is preferably T-shaped, having a wide channel 24 and a narrow throat 25.

The spreader blade 12, which is assembled with and detachable from the handle 11 as a unit, is preferably a relatively stiff molded plastic body 26 having an imbedded heating element 27. As shown the ends of element 27 are connected by imbedded wires to projecting contact prongs 31 and 32 that extend from a flat face 33 in the recessed upper corner 34 of the body.

The upper edge of body 26 is formed as a straight T-shaped ledge or flange 35 that fits slidably into guideway 23, so that in practice the blade unit 11 is mounted on the handle simply by fitting the end of ledge or flange 35 above the contact prongs into the end of guideway 23 and pushing the handle and blade together until handle portion 22 enters recess 34 and prongs 31, 32 enter socket contacts 18, 19 of the handle to automatically establish an electrical circuit to the heating element.

The dimensions are such that the blade is fully installed when faces 33 and 21 abut, the blade preferably extending the length of the handle as shown in FIG. 1.

Blade 12 is preferably molded of nylon, TEFLON or some hard electrically insulating heat conductive synthetic plastic material capable of withstanding the mechanical forces and the temperatures involved, and capable of maintaining a hard smooth surface especially along the straight lower edge 36 wherein the body is laterally tapered for improving the spreading action. A glass fibre reinforced plastic may be used for body 26.

Figure 2:
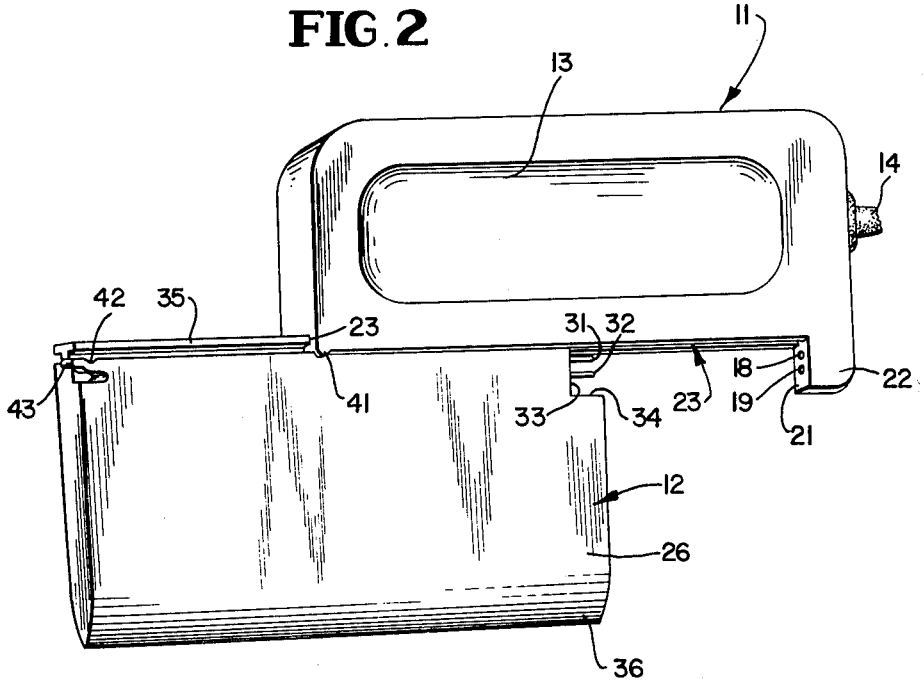
FIG. 2 is a view similar to FIG. 1 but showing the blade partially installed on the handle.
Figure 3:
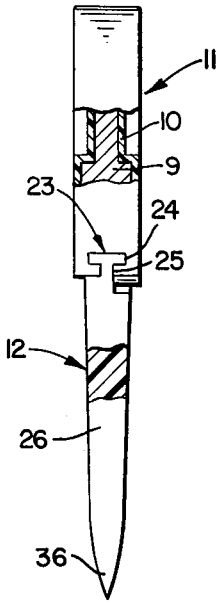
FIG. 3 is an end view of the assembly of FIG. 1.

As shown in FIG. 2, the lower handle corner remote from the socket may be formed with a detent 41 that slides along the top of the blade body until it reaches a notch 42 on the top of an integral clip formation 43 that is essentially a resilient lever catch and holds the blade on the body as shown in FIG. 1. When it is desired to detach the blade it is necessary only to push down on lever 43 to release the detent and then pull the blade away from the handle.

It will be observed that the heating element 27 is preferably located to extend along the lower tapered edge region of the blade where the blade is of least thickness, and it is of such characteristics as to heat the adjacent blade surfaces well in excess of room temperature.

Where the tool is intended for smoothing and curing a plastic filler as in automobile body repair, the temperature must be high enough to rapidly cure the plastic as it spreads and smoothes it. However the temperature should be kept low enough to avoid dangerous burns if accidentally touched by the operator, and so a blade surface temperature of about 150° F is preferred.

If desired a switch 44 may be provided in cord 14.

In use the mixed epoxy or like resin is applied to the dents or like in the metal part to be repaired and immediately the hot spreader blade is used to spread and smooth and at the same time accelerate the curing of the filler.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A spreader assembly comprising an elongated handle unit having a longitudinal edge and containing electrical contact means attached to means for connecting the same to a source of power and an elongated electrically heated spreader blade unit detachably mounted on said handle unit, said handle unit having slide means along said longitudinal edge, said blade unit having a pair of opposite longitudinal edges, said blade unit having along one longitudinal edge a smooth surfaced spreading and smoothing region laterally tapering to a minimum thickness at said one longitudinal edge and along the opposite longitudinal edge slide means providing an interfitting slide connection with the slide means of the handle unit for detachably coupling said units together and said blade unit having an imbedded electrical heater element connected to contacts positioned on the blade unit so as to engage with the contacts on said handle unit when the blade unit has been slidably mounted in operative position on said handle unit with the slide means of said handle unit and blade unit interfittingly connected.

2. The spreader assembly defined in claim 1, wherein said contacts on the respective units comprise a socket on one unit and cooperating projecting prongs on the other unit.

3. The spreader assembly defined in claim 2, wherein said contacts on the handle unit are on a depending portion along said longitudinal edge and the contacts on the blade unit are in an upper edge corner recess adapted to fit with said depending portion in assembly.

4. The spreader assembly defined in claim 1, wherein said handle unit comprises a rigid frame having at least its outer surface composed of thermal and electrical insulation material and said blade unit is composed of a suitably stiff synthetic heat conductive electrically insulating plastic wherein the heater element is molded.

5. The spreader assembly defined in claim 1, wherein the lower edge region of said blade is of substantially the same cross section along its length.

6. The spreader assembly defined in claim 1, wherein said slide connection between the units comprises a generally T-shaped groove along said longitudinal edge of the handle unit and a corresponding shaped flange along the edge of the blade unit adapted to be inserted into said groove at one end of the handle unit.

7. The spreader unit defined in claim 6, wherein releasable latch means is provided for retaining the handle and blade units in assembly.

8. The spreader unit defined in claim 1, wherein said blade unit is composed of a material selected from the group consisting of nylons and polytetrafluoroethylenes.

9. The spreader assembly defined in claim 1, wherein said handle and blade units extend coextensively and are substantially of the same length.

* * * * *